US005735207A

United States Patent [19]

Döpke, deceased et al.

[11] Patent Number: 5,735,207

[45] Date of Patent: Apr. 7, 1998

[54] DEVICE FOR ADJUSTING GUIDE YOKES IN ROTARY PRINTING PRESSES

[75] Inventors: Stefan Otto Adolf Döpke, deceased, late of Rehburg-Loccum; Franz-Adolf Döpke, heir, Rehburg-Loccum; Katrin Ewert, heir, Jügesheim-Rottgau; Jürgen Rautert, Heidelberg, all of Germany

[73] Assignee: Heidelberger Druckmaschinen Aktiengesellschaft, Heidelberg, Germany

[21] Appl. No.: 741,788

[22] Filed: Nov. 1, 1996

[30] Foreign Application Priority Data

Nov. 4, 1995 [DE] Germany ..... 29517472 U

[51] Int. Cl.[6] ..... B41F 5/00

[52] U.S. Cl. ..... 101/216; 101/232; 271/314

[58] Field of Search ..... 101/212, 216, 101/219, 232, 141, 142, 153, 174, 183, 407.1, 424.1, 231, 233, 175, 136, 137; 271/314

[56] References Cited

U.S. PATENT DOCUMENTS

| | | | |
|---|---|---|---|
| 3,498,217 | 3/1970 | Kletti | 101/216 |
| 4,384,524 | 5/1983 | Simeth et al. | 101/232 |
| 4,454,812 | 6/1984 | Johne et al. | 101/212 |
| 4,869,169 | 9/1989 | Rebel et al. | 101/408 |
| 5,241,903 | 9/1993 | Lampig | 101/216 |
| 5,546,858 | 8/1996 | Stephan | 101/142 |
| 5,632,202 | 5/1997 | Robesin et al. | 101/216 |

FOREIGN PATENT DOCUMENTS 4242606 8/1993 Germany .

*Primary Examiner*—Eugene H. Eickholt
*Attorney, Agent, or Firm*—Nils H. Ljungma and Associates

[57] ABSTRACT

A device for adjusting guide yokes in rotary printing machines which are placed on a crossbeam crosswise to the direction in which the sheets travel, and which guide the sheets that are transported by a cylinder; each of the guide yokes are mounted, movable and lockable, on the crossbeam, and the crossbeam is at both ends fastened to the machine side racks.

8 Claims, 3 Drawing Sheets

DEVICE FOR ADJUSTING GUIDE YOKES IN ROTARY PRINTING PRESSES

BACKGROUND OF THE INVENTION

1. Field of the Invention

The present invention concerns a device for adjusting guide yokes in rotary printing presses which are placed on a crossbeam crosswise to the direction in which the sheets travel, and which guide the sheets that are transported by a cylinder; each of the guide yokes are mounted, movable and lockable, on the crossbeam, and the crossbeam can be at both ends fastened to the machine side racks.

2. Background Information

Such a device is shown in German Patent No. 42 42 606 C2. There the guide yokes are, by a drive, reset to a new measure, and the printer cannot change their side positions individually. This, however, could be necessary, for example, if a guide yoke should be set on an area of the printed sheet that is to be clear of print. With this known solution, however, all tongues are force-guided sideways.

OBJECT OF THE INVENTION

The object of the present invention is to create the possibility for a simple and quick adjustment of the guide yokes—this can be carried out manually by the printer.

SUMMARY OF THE INVENTION

According to the present invention, the problem can be solved as follows: The crossbeam can have a profile guide; the guide yokes are fastened to holders which can be placed, movable, on the profile guide; and clamping bolts are preferably provided for in the holders—these clamping bolts can clamp the holders with the guide yokes on the profile guide by utilizing the force of a spring. This solution enables the printer to simply move the guide yokes to exactly that position deemed optimal by the printer, without requiring another drive.

In an advantageous embodiment of the invention the clamping bolts have an incline which supports itself against the profile guide by utilizing the force of a compression spring, and the clamping bolt extends above the holder so that the clamping can be released manually. With this design the printer need only depress the clamping bolt, and is able to simply perform a sideways movement of the guide yokes. As soon as the clamping bolt is no longer depressed, the holder with the guide yoke is securely clamped on the guide profile and is not able to move by itself.

It is also beneficial that the clamping bolt is unable to turn in the holder because of a neck. As a result of this, it is possible to simply remove guide yokes from the profile guide and clip them on again, respectively, without having this motion impeded by the clamping bolt.

The above discussed embodiments of the present invention will be described further hereinbelow with reference to the accompanying figures.

BRIEF DESCRIPTION OF THE DRAWINGS

An embodiment of the present invention is schematically illustrated in the drawings, in which.

DESCRIPTION OF THE PREFERRED EMBODIMENT

Figure 1:
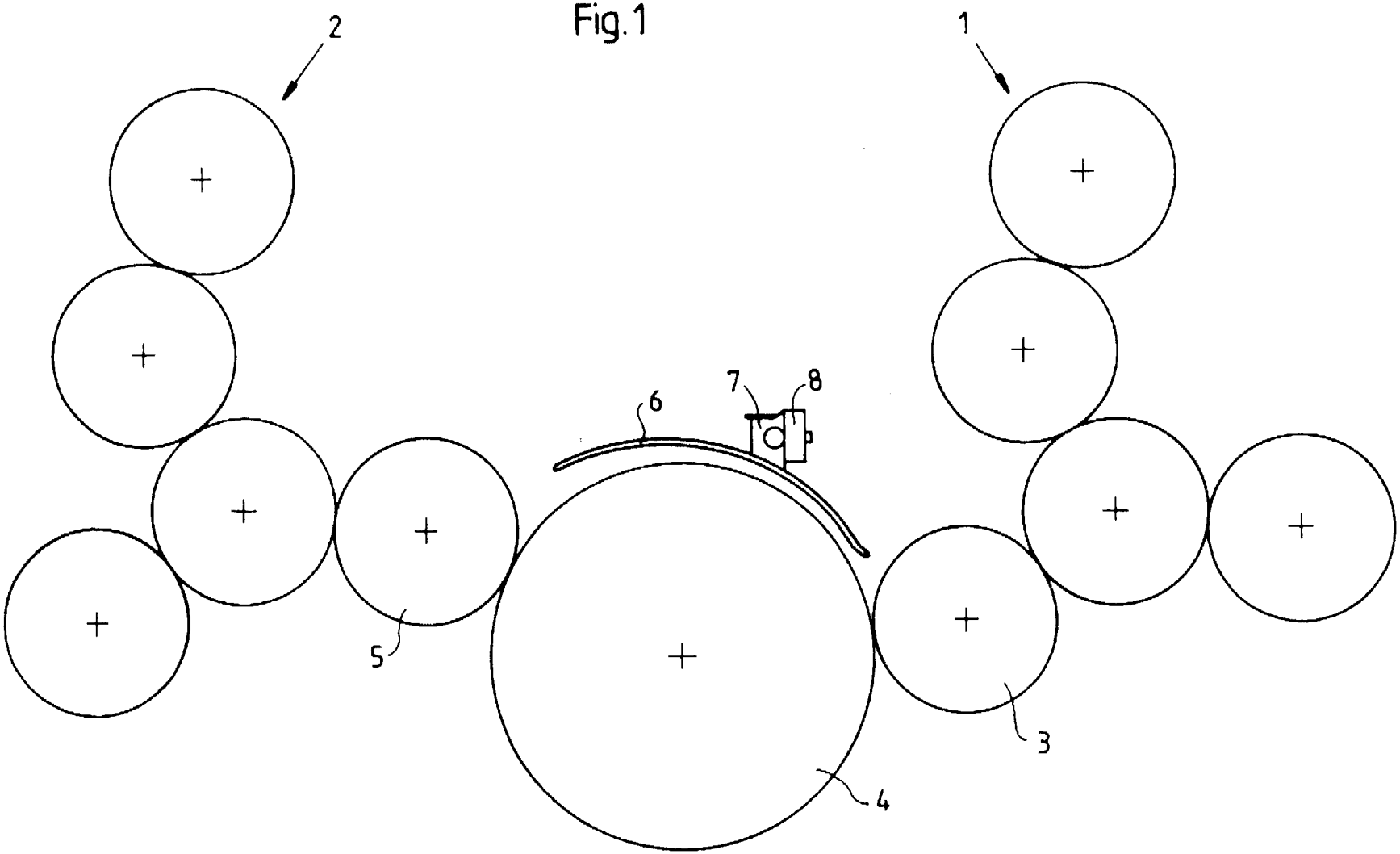
FIG. 1 shows a rotary printing press with guide yokes in a side view.

FIG. 1 shows a part of a sheet rotary printing machine with two printing mechanisms 1 and 2 between which the sheets which are to be transported are conveyed by transfer cylinders 3, 4, 5. Here the guide yokes 6 are assigned to the transfer cylinder 4; these guide yokes are fastened to the holders 7. The holders 7, on the other hand, are mounted, movable and lockable, on a crossbeam 8. The crossbeam 8 is, for example, at both ends, fastened to the machine side racks.

Figure 2:
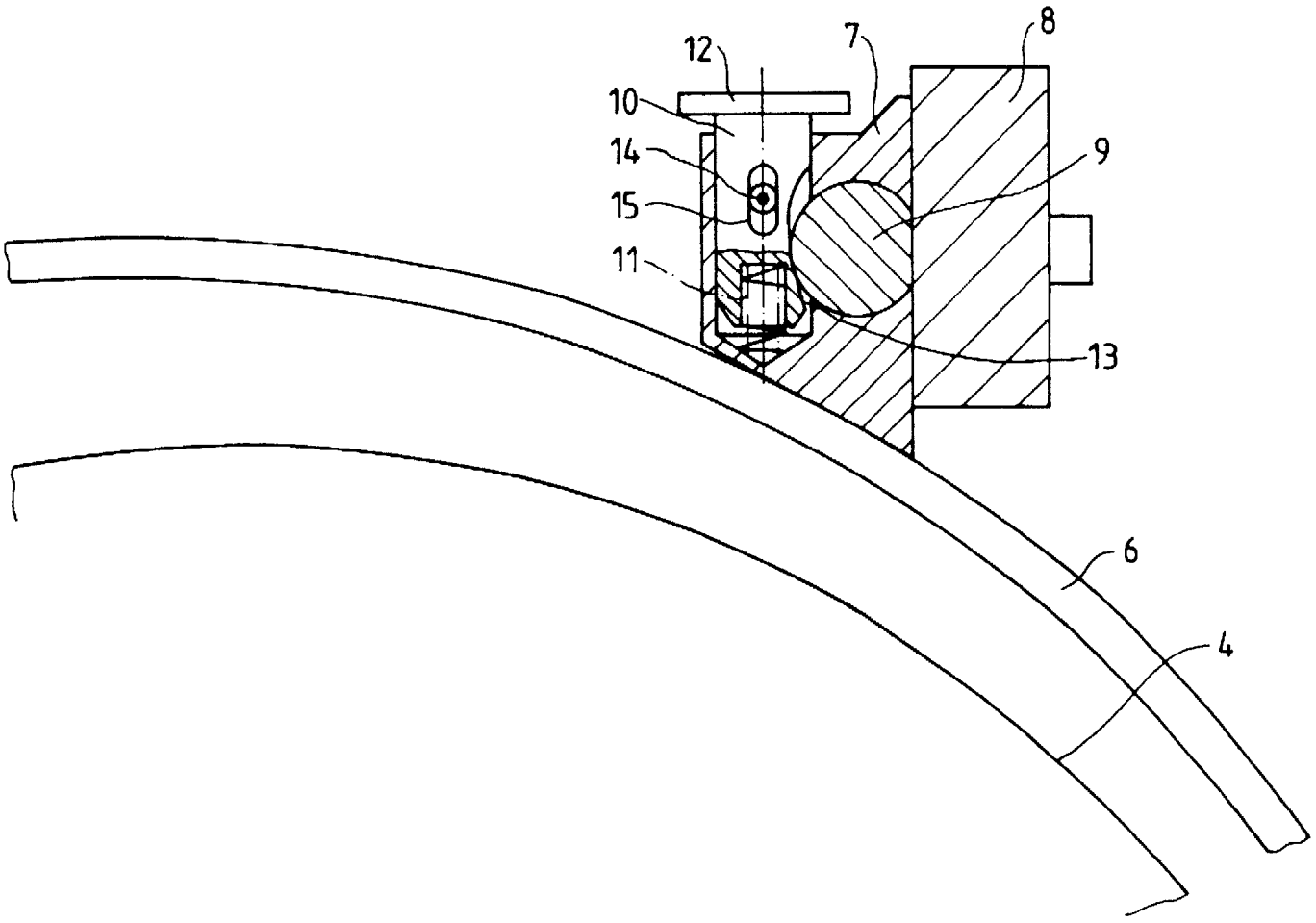
FIG. 2 shows the constructional design of the adjusting device in a cross-sectional view.

As shown in FIG. 2, a profile guide 9 can be provided for on the crossbeam 8; this profile guide is either directly designed on the crossbeam 8 through the appropriate election of its cross section or it can be fastened to the crossbeam 8 as a profiled ledge 9. The holder 7 can embrace this profile guide 9 so that the holder 7 is movable lengthwise along the crossbeam 8 and is crosswise to the crossbeam 8, and prevented from tipping. Because of this, the guide yoke 6 which is fastened to the holder 7 is stabilized in its position in relation to the lateral area of the transfer cylinder 4.

To further explain, the profile guide 9 and the crossbeam 8 can be constructed from one continuous piece of material, or formed separately from two separate pieces which are subsequently joined to one another. The holder 7 is clamped to the profile guide 9 in such a manner as to allow it to be easily moved along and repositioned on the crossbeam 8. The holder 7 can be designed so as to firmly grip the profile guide 9 so that the guide yoke 6, which is fastened to the holder 7, is also securely stabilized in its position in relation the transfer cylinder 4.

A clamping bolt 10 is preferably provided for in the holder 7; in the example of a working design shown, this clamping bolt 10 is pushed up by utilizing the force of a compression spring 11. The clamping bolt 10 extends above the holder 7 and has a head 12 so that the clamping bolt 10 can be pushed down easily. Further, an incline 13 is provided for on the clamping bolt 10; this incline 13 is designed in such a way that when the clamping bolt 10 is pushed up by the compression spring 11 the clamping bolt 10 is clamped against the profile guide 9 and thus prevents the holder 7 from moving. Here the incline 13 supports itself against the profile guide 9. The clamping can be released manually by pushing down on the clamping bolt 10. A bolt 14 is provided for in the holder 7; in the example of a working design shown, this bolt 14 is placed in a slot 15 of the clamping bolt 10 so that the clamping bolt 10 and thereupon also the spring 11 are secured, and when the clamping bolt 10 is moved up and down it is unable to turn against the holder 7.

Figure 3:
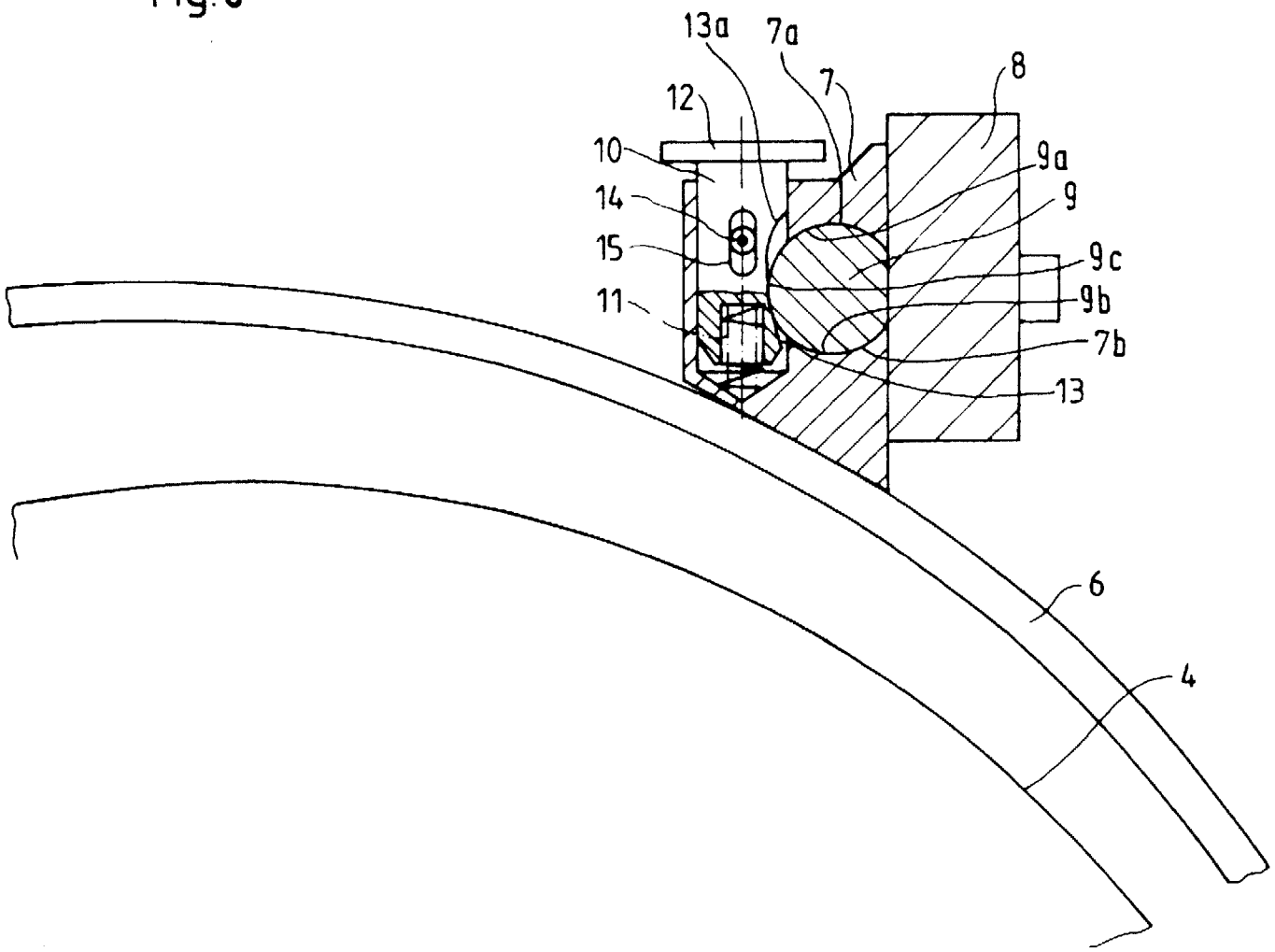
FIG. 3 shows the same view as FIG. 2 with additional details referenced.

To further explain, as can be seen in FIG. 3, in at least one embodiment, the holder 7 can have side portions **7*a* and 7*b* which are substantially contoured to fit about, yet be movable with respect to, the respective side surfaces 9*a* and 9*b* of the profile guide 9. The clamping bolt 10 which is disposed in part within the holder 7, can also has a corresponding groove 13*a*. A portion of this groove 13*a* can be substantially contoured to the shape of an end surface 9*c* of the profile guide 9. This groove 13*a* can include the incline 13 on its bottom edge. Groove 13*a* can be configured and positioned such that when the head 12 of the clamping bolt 10 is pushed down, this groove portion is substantially aligned with end surface 9*c* of the profile guide 9, thereby allowing the holder 7, and guide yoke 6, to be moved or slid along the profile guide 9 of the crossbeam 8. Once the guide yoke 6 is in its desired position, the head 12 of the clamping bolt 10 can be manually released by the printer, and the compression spring 11 can then bias incline 13 upward, and against, the profile guide 9, thereby clamping the holder 7, and the guide yoke 6, in the desired position on the crossbeam. Further, a bolt 14 can be inserted in a slot 15 in the clamping bolt 10, for securing the clamping bolt 10 in the holder 7, and thus securing the compression spring 11 as well, and for maintaining the correct positioning of the clamping bolt 10 during use. Additionally, the groove 13***a* can also serve to essentially prevent the turning of the clamping bolt 10 within the holder 7.

In one embodiment of the present invention, the holder 7, and the profile guide 9 can be configured so that when the head 12 of clamping bolt 10 is pushed downward, the holder 7, and guide yoke 6, can be simply clipped on or off of the profile guide 9.

One feature of the invention resides broadly in the device for adjusting guide yokes 6 in rotary printing machines which are placed on a crossbeam 8 crosswise to the direction in which the sheets travel, and which guide the sheets that are transported by a cylinder; each of the guide yokes 6 are mounted, movable and lockable, on the crossbeam 8, and the crossbeam 8 is at both ends fastened to the machine side racks, distinguished in that—the crossbeam 8 has a profile guide 9,—the guide yokes 6 are fastened to the holders 7 which are placed, movable, on the profile guide 9, and—clamping bolts 10 are provided for in the holders 7; these clamping bolts clamp the holders 7 with the guide yokes 6 on the profile guide 9 by utilizing the force of a spring 11.

Another feature of the invention resides broadly in the device distinguished in that—the clamping bolts 10 have an incline 13 which supports itself against the profile guide 9 by utilizing the force of a compression spring 11, and—the clamping bolt 10 extends above the holder 7 so that the clamping can be released manually.

Yet another feature of the invention resides broadly in the device—distinguished in that the clamping bolt 10 is secured in the holder 7 by means of a bolt 14.

Types of arrangements for smoothing a sheet on a cylinder in a printing press, components of which may be used with at least one embodiment of the present invention may be disclosed in: U.S. Pat. No. 5,546,858 to Stephan on Aug. 20, 1996; U.S. Pat. No. 5,156,190 to Wirz on Oct. 20, 1992; U.S. Pat. No. 2,764,408 to Weiler in September of 1956; U.S. Pat. No. 4,060,238 to Simeth in November of 1977; U.S. Pat. No. 4,395,949 to Jeschke in August of 1983; U.S. Pat. No. 3,506,259 to Caldwell et al. in April of 1970; U.S. Pat. No. 3,949,671 to Madigan in April of 1976; U.S. Pat. No. 3,986,455 to Jeschke in October of 1976; and U.S. Pat. No. 4,099,463 to Zimermann in July of 1978.

Examples of printing machines and/or presses which may be used in conjunction with, or which may contain components and/or accessories that may be used in conjunction with, at least one embodiment of the present invention may be disclosed in the following U.S. Pat. Nos. 5,377,587, 5,377,589; 5,379,697; 5,381,734; 5,383,395; 5,388,511; 5,390,597; 5,392,710; 5,398,603; 5,400,709; 5,404,806; and 5,408,928.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents recited herein, and in the Declaration attached hereto, are hereby incorporated by reference as if set forth in their entirety herein.

The corresponding foreign patent publication application, namely, Federal Republic of Germany Patent Application No. 295 17 472.2, filed on Nov. 4, 1995, having inventors Stefan Döple and Jürgen Rautert, is hereby incorporated by reference.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

PARTIAL LIST OF REFERENCE NUMBERS

1. Printing mechanism
2. Printing mechanism
3. Transfer cylinder
4. Transfer cylinder
5. Transfer cylinder
6. Guide yoke
7. Holder
8. Crossbeam
9. Profile guide
10. Clamping bolt
11. Compression spring
12. Head
13. Incline
14. Bolt

What is claimed is:

1. Device for adjusting guide yokes in rotary printing presses, the rotary printing presses comprising side racks, and at least one rotatably mounted cylinder for advancing sheets of printing stock, the cylinder having an outer circumferential surface, said device for adjusting guide yokes comprising:

a crossbeam fastened to the side racks of the press and disposed substantially transverse to the direction of travel of the sheets of printing stock;

a profile guide disposed along said crossbeam;

a holder disposed on said profile guide;

a guide yoke for guiding the sheets of printing stock along the outer circumferential surface of the cylinder during rotation of the cylinder;

said guide yoke being attached to said holder;

a clamping bolt disposed in part within said holder;

said clamping bolt comprising a mechanism for releasably clamping said holder onto said profile guide; and said mechanism comprises a biasing spring.

2. The device for adjusting guide yokes according to claim 1, wherein:

said clamping bolt comprises a portion which extends beyond said holder;

said portion is configured to permit movement of said clamping bolt in a first direction and in a second direction;

said first direction being substantially toward said holder and said second direction being substantially away from said holder;

said holder has a clamped position and an unclamped position;

said clamping bolt is manually movable said first direction to provide said unclamped position of said holder;

said clamping bolt is biased in said second direction by said biasing spring to provide said clamped position of said holder;

said clamping bolt comprises a groove adjacent said profile guide;

said groove comprises an inclined area;

said biasing spring is disposed to bias said inclined area against said profile guide when said holder is in said clamped position; and said groove being substantially aligned with said profile guide in said unclamped position.

3. The device for adjusting guide yokes according to claim 2, further comprising a fastening bolt for securing said clamping bolt within said holder.

4. The device for adjusting guide yokes according to claim 1, further comprising a fastening bolt for securing said clamping bolt within said holder.

5. Device for adjusting guide yokes in rotary printing machines which are placed on a crossbeam crosswise to the direction in which the sheets travel, and which guide the sheets that are transported by a cylinder; each of the guide yokes are mounted, movable and lockable, on the crossbeam, and the crossbeam is at both ends fastened to the machine side racks, distinguished in that:

the crossbeam has a profile guide, the guide yokes are fastened to the holders which are placed, movable, on the profile guide, and clamping bolts are provided for in the holders; these clamping bolts clamp the holders with the guide yokes on the profile guide by utilizing the force of a spring.

6. Device pursuant to claim 5, distinguished in that:

the clamping bolts have an incline which supports itself against the profile guide by utilizing the force of a compression spring, and the clamping bolt towers above the holder so that the clamping can be released manually.

7. Device pursuant to claim 5, distinguished in that:

the clamping bolt is secured in the holder by means of a bolt.

8. Device pursuant to claim 6, distinguished in that:

the clamping bolt is secured in the holder by means of a bolt.

* * * * *